United States Patent [19]

Cline

[11] Patent Number: 4,467,513

[45] Date of Patent: Aug. 28, 1984

[54] DRUM BRAKE CONVERSION METHOD AND APPARATUS FOR A TURRET UNWINDING STAND

[76] Inventor: David M. Cline, 312 Hunting Hollow Rd., Greenville, S.C. 29615

[21] Appl. No.: 393,636

[22] Filed: Jun. 30, 1982

[51] Int. Cl.[3] ..... B23P 7/00

[52] U.S. Cl. ..... 29/401.1; 242/156

[58] Field of Search ..... 29/401.1; 242/156.2, 242/156, 75.4, 75.42, 75.45, 75.47, 75.43

[56] References Cited

U.S. PATENT DOCUMENTS

| | | | |
|---|---|---|---|
| 2,128,387 | 8/1938 | Wehr | 188/221.1 X |
| 2,281,535 | 4/1942 | Drews | 188/221.1 X |
| 3,223,352 | 12/1965 | Fuller et al. | 242/156.2 |
| 3,430,738 | 3/1969 | Dain et al. | 188/221.1 X |
| 3,743,062 | 7/1973 | McIlroy | 188/221.1 X |
| 4,365,768 | 12/1982 | Woodruff | 242/156.2 |

*Primary Examiner*—Howard N. Goldberg
*Assistant Examiner*—V. K. Rising
*Attorney, Agent, or Firm*—Dority & Flint

[57] ABSTRACT

A method and apparatus are illustrated for converting a brake on a rotating turret arm 12 of a paper unwinding stand 10 from a disc brake unit to a drum brake unit which includes providing an adapter bracket 30 by means of which the turret arm 12 accommodates drum brake structure in place of the disc brake unit. The adapter bracket means 30 includes an attachment flange 32 which attaches directly to a mounting plate 22 of a removed disc brake unit 20. A support flange 34 is carried by the attachment flange which pivotably supports brake shoe means 36, 38 which engage a brake drum 46 adapted for connection to an end 16*a* of the paper roll shaft 16. The drum is hollow and includes a rotary union 60 through which a cooling fluid is circulated.

3 Claims, 6 Drawing Figures

Fig. 5.
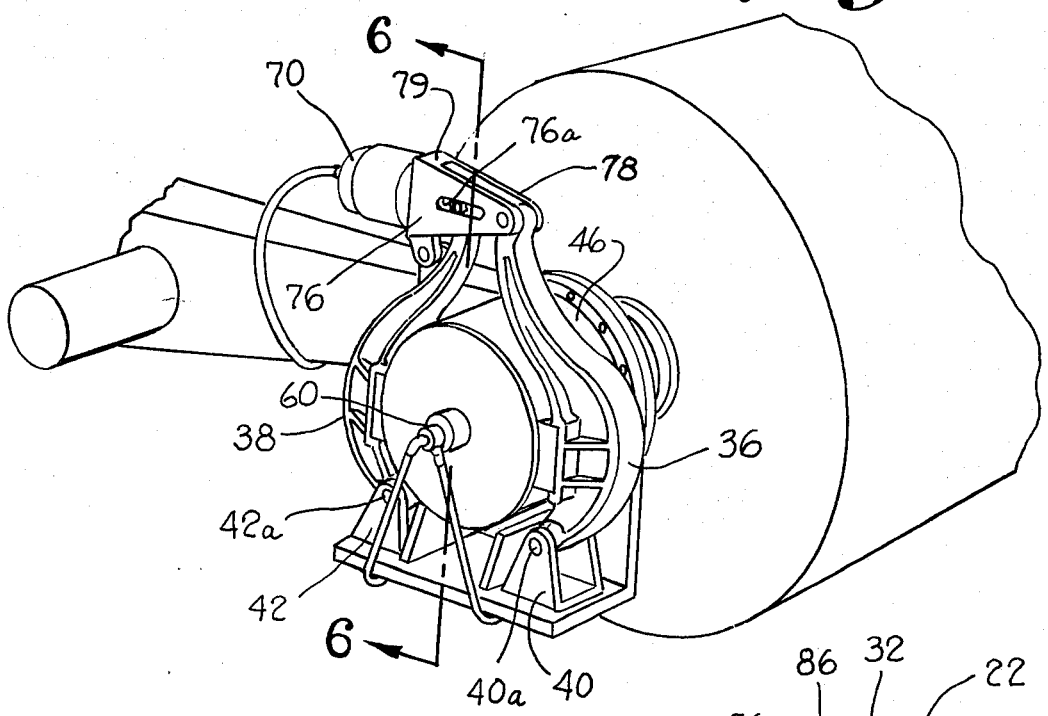
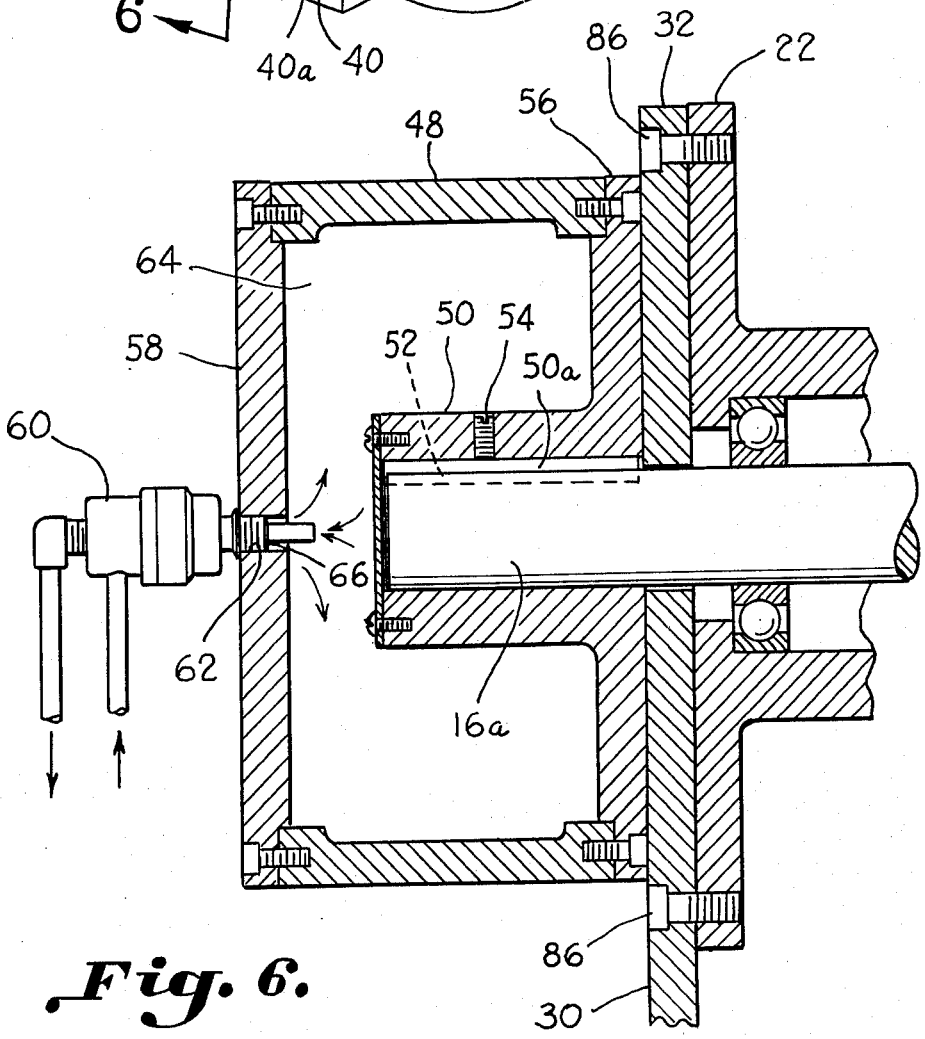
Fig. 6.

DRUM BRAKE CONVERSION METHOD AND APPARATUS FOR A TURRET UNWINDING STAND

BACKGROUND OF THE INVENTION

The invention relates to a brake tensioning device for braking a paper roll unwinding on a turret stand of the type utilized in paper converting plants. Typically, the turret stand includes rotating turret arms which carry two rolls of paper. Paper sheeting is unwound from the winding stand for use in a conversion process such as in the manufacture of milk cartons. When the paper on one roll is depleted, the turret arms turn to present a full roll in position for continuous supply of paper to the paper converting process. During the unwinding process, the shaft of the rotating paper roll is braked to maintain a desired tension on the paper sheet being unwound from the roll.

Heretofore, various arrangements of pneumatically actuated disc brake units have been utilized on the turret arms of the unwinding stand to brake and tension the paper roll. Since considerable friction is imparted to the brake unit due to the continuous braking action, these disc brake units have been air or water cooled. A very popular type of water cooled disc brake unit is illustrated in prior art FIG. 2 which is commonly referred to as a Fawick or Wichita clutch brake. One such a brake is manufactured by the Airflex Division of the Eaton Corporation of Cleveland, Ohio as the Airflex WC and WCA clutch brake units.

The disc brake units include brake rotors which are coupled to the rotating shaft of the paper roll either by a spline or by a gear arrangement. Braking discs are carried within the disc brake units which are normally constructed of copper and are moved by pneumatic actuation into engagement with the brake rotors to apply a braking action and tension the paper roll during unwinding. A series of minute water passages are formed in a jacket behind the copper brake disc through which a cooling medium is circulated, such as water, to cool the brake unit. The problem exists that these water passages often become clogged from minerals, rust, corrosion, and other particulate matter. The brake unit then becomes overheated and often melts and is destroyed. In many environments, the life of such a disc brake unit is only several months. Various other attempts to cool such a disc brake unit have not been satisfactory. The problem is complicated by the fact that the paper rolls are mounted on turret arms which must rotate on the unwinding stand. Hence, the disc-type brake unit which is lightweight and simple in construction and in attachment to the turret arm has been utilized in such applications.

Drum type brake units have been utilized on single roll unwinding stands such as shown in U.S. Pat. No. 3,430,738. These type brake units are attached to an associated stationary base on a floor surface. The need to have rotating brake structure is not required in such an arrangement.

Accordingly, an important object of the present invention is to provide a brake unit for a turret unwinding stand for unwinding paper which increased cooling capacity and a reliable cooling system.

Another important object of the present invention is to provide a simplified drum brake which may be rotatably employed on a rotating turret arm of a paper unwinding stand.

Still another important object of the present invention is to provide an apparatus for converting a disc brake to a drum brake unit on a turret arm of a paper unwinding stand.

Still another important object of the present invention is to provide apparatus for converting a disc brake unit to a drum brake unit on a turret arm of a paper unwinding stand in which the drum brake unit has simplified and reliable cooling capacity.

SUMMARY OF THE INVENTION

The above objectives are accomplished according to the present invention by means of a drum brake unit which has increased cooling capacity by means of a fluid circulated through a hollow copper drum having a copper braking surface in engagement with a pair of brake shoes. In particular, the invention contemplates a method and apparatus for converting a brake on a turret unwinding stand from a disc brake to a drum brake unit. The apparatus includes adapter means for adapting the turret arm so that a drum brake unit may be attached to a disc brake mounting plate on the turret arm of a paper unwinding stand. An adapter attachment bracket is provided which mounts directly to the mounting plate of the disc brake unit which includes a vertical attachment flange and a horizontal support flange on which a pair of brake shoes are pivotally carried. A copper brake drum is splined to the shaft of the paper roll and is in engagement with the brake shoes which are pneumatically actuated. A rotary union is carried by the brake drum which circulates a cooling fluid in and out of the hollow interior of the brake drum. Thus, the entire drum brake unit is supported on the end of the turret arm of the unwinding stand in a simplified manner which enables the drum brake unit to rotate with the turret arm. The enlarged hollow capacity of the brake drum allows the drum to be cooled reliably and efficiently without clogging of any minute water passages as occurs in the prior disc brake units. The copper braking surface of the drum dissipates the heat of friction from the brake shoes uniformly through the cooling medium.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 5 is a perspective view of a turret arm of a paper unwinding stand which has been modified to include a drum brake unit in lieu of a disc brake unit according to the present invention;

FIG. 6 is a sectional view taken along line 6—6 of FIG. 5.

DESCRIPTION OF A PREFERRED EMBODIMENT

The invention relates to a brake unit for braking a paper roll from which paper is unwound on a turret arm of a paper unwinding stand. More particularly, the invention is directed to apparatus for converting a disc brake unit on a rotary turret arm of an unwinding stand to a drum brake unit. Since turret unwinding stands for paper rolls and their application such as in converting plants which convert stocks of sheet paper into products such as milk cartons are well known, only so much of an unwinding stand and its application as is necessary to an understanding of the invention will be illustrated herein.

Figure 1:
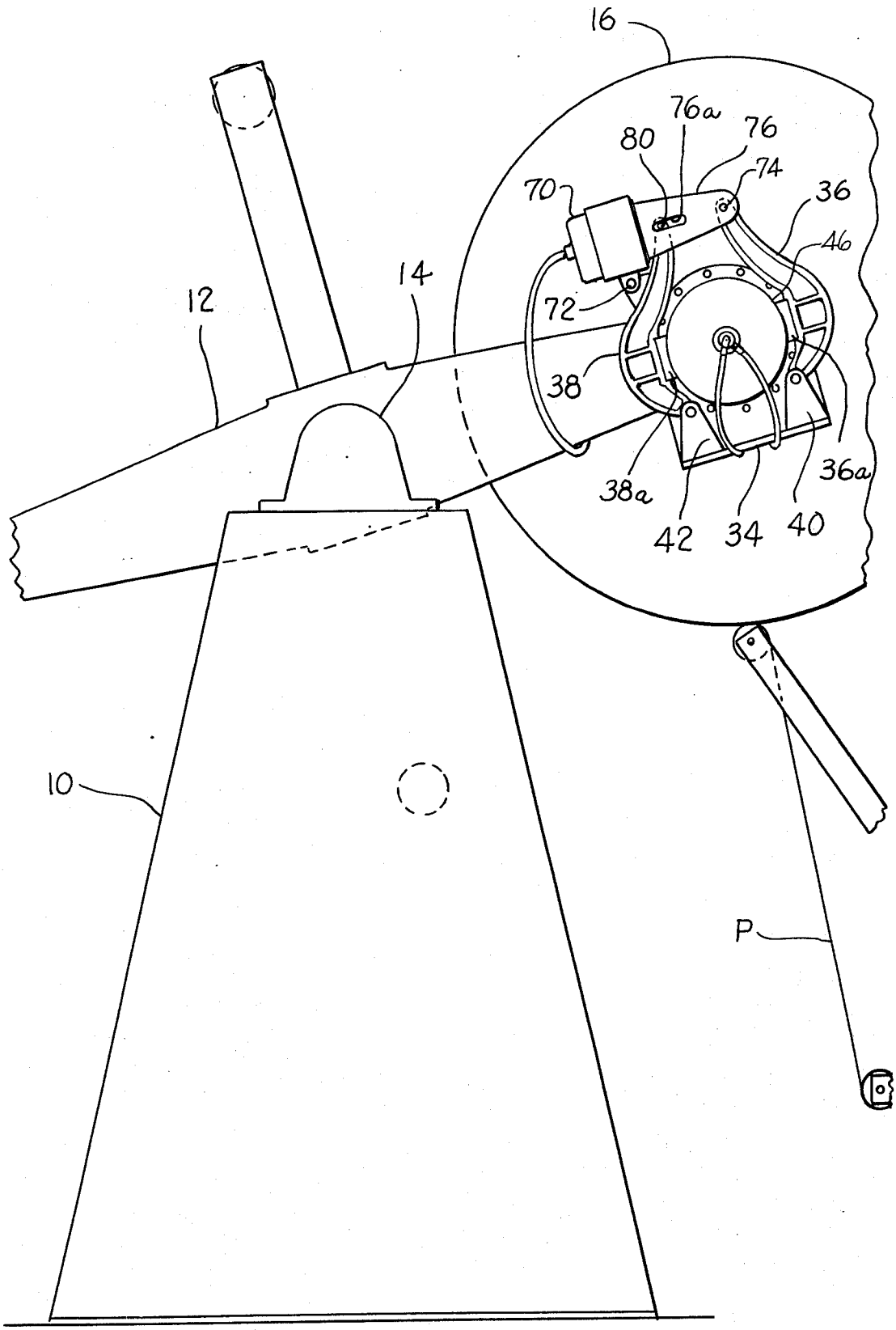
FIG. 1 is an elevation of a turret unwinding stand for unwinding rolls of paper supported on the stand incorporating a drum brake unit according to the invention.

Accordingly, FIG. 1 illustrates a paper unwinding stand 10 which includes a turret arm 12 rotatably carried on the unwinding stand 10 by means of a shaft 13 rotatably journalled at 14. A similar turret arm would be carried on an opposite side of the unwinding stand such that a paper roll 16 is carried between one end of the two spaced turret arms and a second paper roll (not shown) will be carried on a remote end and between the two turret arms. Each paper roll has a shaft 16*a* having one end which is rotatably journaled in the turret arm (not shown) and a remote end which makes connection with the braking unit extending through the turret arm. The connecting end is splined to receive a braking member of a brake unit attached to the turret arm.

Figure 2:
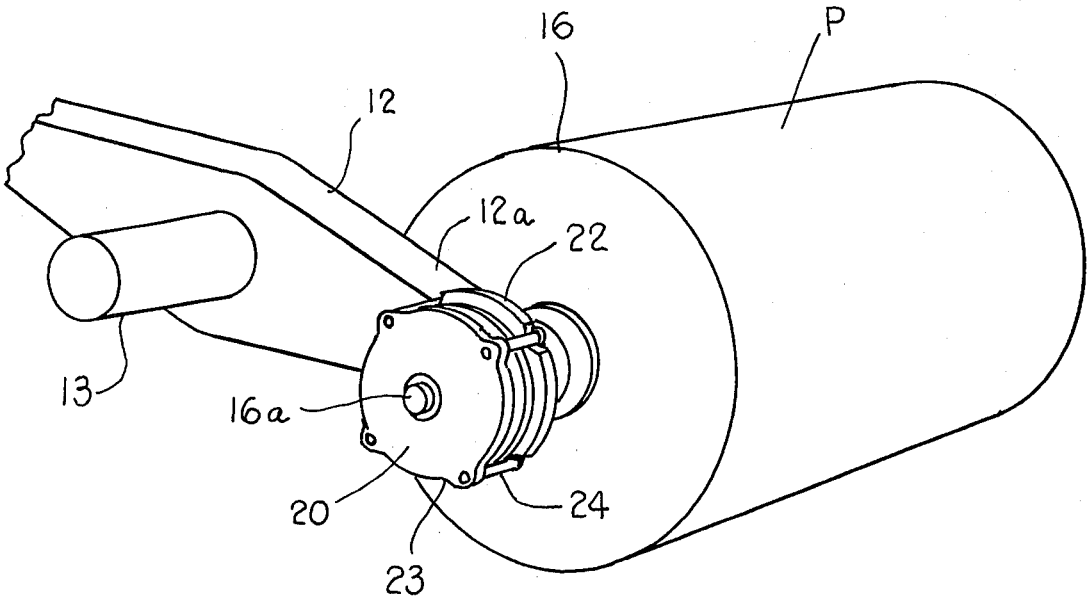
Fig. 2. PRIOR ART
FIG. 2 is a partial perspective view of the turret unwinding stand of FIG. 1 with a prior art disc brake unit mounted to the turret arm for tensioning the paper roll.
Figure 4:
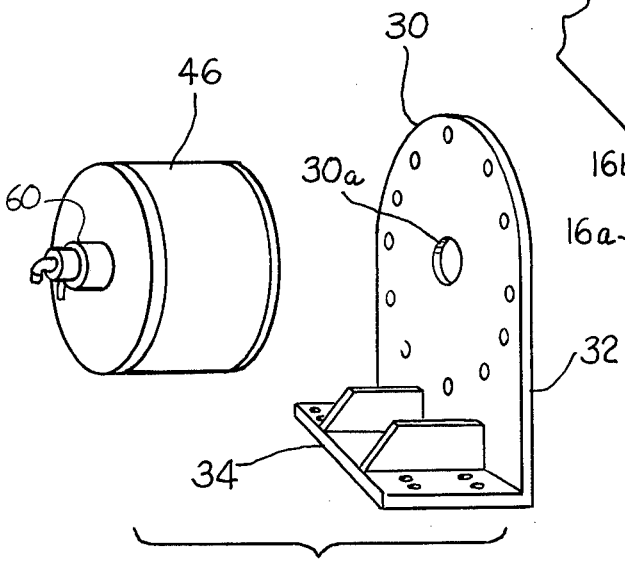
FIG. 4 is an exploded view of apparatus for converting the disc brake unit of FIG. 2 to a drum brake unit in accordance with the present invention.
Figure 3:
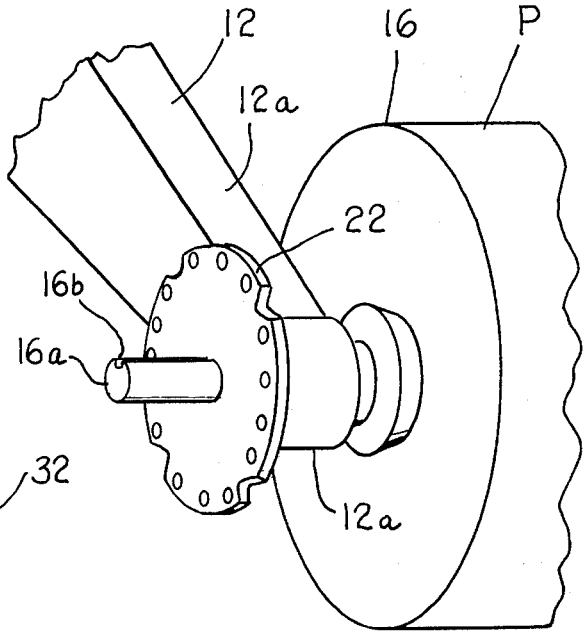
PRIOR ART Fig. 3.
FIG. 3 is an enlarged perspective view of the prior art turret arm of FIG. 2 with the disc brake unit removed except for the disc brake mounting plate.

Referring to the prior art FIG. 2, a disc brake unit 20 is shown attached to an end 12*a* of turret arm 12 which includes a disc brake housing 23 attached to a disc brake mounting plate 22 typically made integral with the turret arm 12 such as by a one-piece casting or other unitary structural arrangement. The disc brake housing 20 is attached by means of bolts 24 to the mounting plate 22. The disc brake unit 20 is actuated by conventional pneumatic means and is water-cooled by circulating water through minute passages formed in the braking discs in a conventional manner.

In accordance with the present invention, disc brake unit 20 is replaced and the turret arm 12 converted to a drum brake arrangement by means of apparatus which includes an adapter bracket means 30 which mounts directly to the disc brake mounting plate 22 of the prior disc brake unit 20. The bracket means 30 includes a vertical attachment flange 32 and a horizontal support flange 34 by means of which a pair of brake shoe assembly means 36 and 38 are carried. Means for pivotally attaching the brake shoes to the support flange 34 includes a pivot assembly 40 and 42 bolted to the horizontal support flange 34. A pivot pin 40*a* and 42*a* pivotally connects the respective brake shoe to the pivot support. The shaft 16*a* of the paper roll 16 is journalled in the end 12*a* of the turret arm and extends through an opening 32*a* in the vertical attachment flange 32 as well as mounting plate 22. A hollow brake drum 46 is carried on the shaft 16*a* of the paper roll.

Brake drum 46 includes a braking wall surface 48 which is preferably constructed of copper or other suitable heat conducting material. The brake drum includes an inwardly turned hub 50 which is connected to the shaft 16*a* of the paper roll by means of a spline and keyway. A key 52 may be inserted in the spline 16*b* in the shaft and a corresponding spline 50*a* formed in the hub. A set screw 54 may then be turned to lock the key in place. The interior hub 50 is connected to the copper braking surface 48 by means of a bolt-on plate 56 and the front of the brake drum includes a bolt-on flange plate 58 connected to the copper braking surface 48. Suitable sealing may be provided as is necessary.

A conventional rotary union 60 is fitted in an opening 62 formed in the front plate 58. The rotary union 60 may be any suitable rotary union such as that manufactured by The Deublin Manufacturing Co. as a No. 555 rotary union. A cooling medium such as water enters the interior 64 of the braking drum by means of openings 66 and leaves the interior of the drum through a center pipe 68 which is included in the rotary union.

Means for actuating the brake shoes 36 and 38 urging same against the brake drum includes a pneumatic actuator 70 carried on top of the brake shoes by means of a bearing 72 about which the pneumatic unit is attached to the turret arm 12. The pneumatic unit 70 may be any conventional double-acting air cylinder such as a no. 50 roto-chamber manufactured by the Westinghouse Company. Brake shoe 36 is pivotally carried at 74 between plates 76 and 78 of a fork-shaped member 79 which is fixed to the pneumatic unit 70 in a unitary fashion. The brake shoe 38 includes a pin 80 fixed thereto which is slidably received in a slot 76*a* formed in the leg plate 76 of the bracket 79 and through a corresponding shaped slot in a plate 78 of the fork-shaped bracket. The end of the brake shoe 38 which carries the pivot pin 80 is attached to the piston rod of the pneumatic cylinder unit 70. When the unit 70 is actuated the unit pushes the shoe 38 to the right and, as the unit 70 turns about the bearing 72, the unit 36 is pulled to the left whereby the braking surface 48 of the drum brake unit is frictionally engaged by brake shoe pads 36*a* and 38*a* carried by the respective brake shoes 36 and 38.

As illustrated, the conversion attachment plate 30 of the present invention is bolted to the disc brake mounting plate 22 by means of bolts 86.

It can be seen that an advantageous construction can be had according to the present invention for converting a disc brake unit to a drum brake unit on a rotating turret arm of a paper unwinding stand. The construction of the brake drum apparatus is simplified over prior arrangements which have required stationary mounting facilitating employment as a rotating unit on the turret arm. The drum brake unit has increased cooling capacity for dissipating the heat of friction from the brake shoes 36 and 38 during continuous brake tensioning of the paper roll during unwinding. The hollow interior of the brake drum provides a non-clogging chamber having increased and reliable cooling capacity for the brake unit through which a cooling medium such as water may be circulated without clogging or other detrimental affects as would cause overheating of the brake and destruction.

While a preferred embodiment of the invention has been described using specific terms, such description is for illustrative purposes only, and it is to be understood that changes and variations may be made without departing from the spirit or scope of the following claims.

What is claimed is:

1. A method of converting a brake on a turret arm of an unwinding stand on which paper and the like is unwound from a disc brake unit to a drum brake unit, said turret unwinding stand being of the type having at least one turret arm on each side of said stand between which a shaft of a roll of paper or the like is rotatably carried, said turret arm having a journal opening through which one end of said shaft extends for making connection with said brake, a mounting plate carried on said turret arm through which said one end of said shaft extends and to which said disc brake unit is mounted, said turret arm being rotatably carried for rotational movement relative to said unwinding stand, said method comprising:

providing an adapter bracket for adapting said turret arm to accommodate said drum brake when said disc brake is removed from said disc brake mounting plate for conversion;

attaching said adapter bracket means to said disc brake mounting plate on said turret arm;

providing a brake drum adapted for connection to said one end of said shaft;

pivotably supporting brake shoe means on said adapter bracket for engaging said brake drum;

and providing means for adjustably urging said brake shoe means against said brake drum.

2. The method of claim 1 including providing a rotary union coupled with said brake drum through which a cooling medium is circulated for cooling said brake drum.

3. The method of claim 1 wherein said brake drum is provided with a copper braking surface against which said brake shoe means is urged.

* * * * *